United States Patent [19]

Tomasicchio

[11] 4,018,267

[45] Apr. 19, 1977

[54] CLEANING HEAT EXCHANGER TUBES

[75] Inventor: Giorgio Tomasicchio, Milan, Italy

[73] Assignee: Dorr-Oliver Incorporated, Stamford, Conn.

[22] Filed: Jan. 10, 1975

[21] Appl. No.: 540,124

[52] U.S. Cl. ..... 165/84; 122/379; 165/95

[51] Int. Cl.[2] ..... F28D 11/06; F28G 11/07

[58] Field of Search ..... 122/379; 165/5, 84, 165/1

[56] References Cited

UNITED STATES PATENTS

| | | | |
|---|---|---|---|
| 2,183,496 | 12/1939 | Peters | 165/84 |
| 2,809,615 | 10/1957 | Seidl | 122/379 |
| 3,389,974 | 6/1968 | Barattini et al. | 23/295 |
| 3,721,217 | 3/1973 | Willach et al. | 165/84 |
| 3,835,817 | 9/1974 | Tuomaala | 122/379 |

FOREIGN PATENTS OR APPLICATIONS

| | | | |
|---|---|---|---|
| 789,927 | 7/1968 | Canada | 165/84 |
| 1,045,678 | 11/1953 | France | 165/84 |

*Primary Examiner*—C. J. Husar
*Assistant Examiner*—Theophil W. Streule, Jr.
*Attorney, Agent, or Firm*—H. M. Snyder; Burtsell J. Kearns; Theodore M. Jablon

[57] ABSTRACT

Heat exchanger tubes exposed to high-temperature gases from which dust or scale is deposited on the tubes are subjected to forces applied at the resonant frequency of the tube array to remove deposits on the tube surfaces.

6 Claims, 5 Drawing Figures

CLEANING HEAT EXCHANGER TUBES

This invention relates to a method for cleaning the gas-contacted surfaces of tubular heat exchangers to dislodge solid deposits therefrom. More particularly, the invention is directed to a novel method for effecting vibration of tubular arrays for the purpose of cleaning them.

Some heat exchangers, such as boilers and including economizers and superheaters, have heating surfaces in the form of arrays of serpentine tubes suspended in flue passages which hot, dusty combustion gases must traverse. The serpentine tubular arrays are usually composed of a plurality of relatively long runs of tubing arranged in parallel with the ends of the tubing runs joined by short bend or bight sections so as to form a continuous serpentine or looped tubular member, frequently disposed in a single plane. The tubular arrays acquire a very substantial load of dust and/or scale from the hot gases with which they are in contact and must be regularly cleaned to insure satisfactory heat exchange.

There have been numerous methods and devices proposed for shaking or rapping the tubular arrays with sufficient force to remove the dust or scale deposits from the external tube surfaces. Both manual and automatic means have been used or proposed, but most of these proposals have had certain disadvantages. For example, some methods require the application of excessively large forces to the tubular arrays which can damage them over a period of time, since the tubes must be cleaned at relatively frequent intervals. Other means proposed for cleaning or rapping the tubular arrays involve the installation of bulky equipment within the boiler which is exposed to the action of the combustion gases and is likely to represent an obstacle to the free fall of dust or scale within the boiler.

There is a demonstrable need in the art for a shaking and/or rapping method for dislodging solid deposits from tubular arrays of heat exchangers which will operate with no more than a modest application of force to the tubular arrays while requiring only minimal apparatus within the boiler proper.

It is an object of the invention to provide an improved shaking and rapping method for the tubular arrays of heat exchangers.

It is another object of this invention to provide a shaking and rapping method for the tubular arrays of heat exchangers, wherein a large amplitude of movement of the tubular arrays is achieved with a relatively small expenditure of force.

Figure 1:
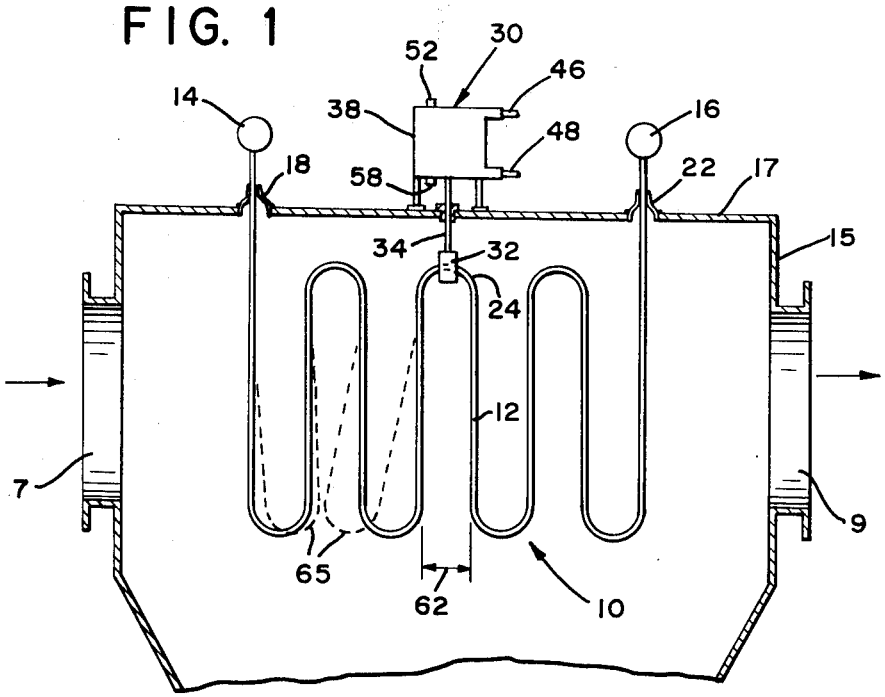
Figure 2:
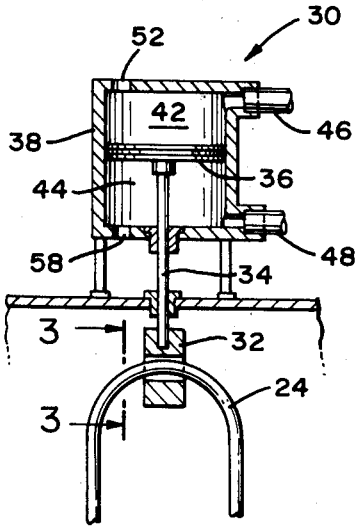
Figure 3:
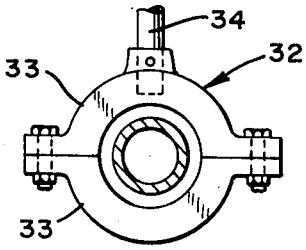

Other objects and advantages of the invention will become apparent from the following description taken in conjunction with the accompanying drawings in which:

FIG. 1 is a diagrammatic view of a tubular array provided with a suitable actuating device for applying the method of the invention, FIG. 2 is an elevational view, enlarged and partially in section, of the actuating device of FIG. 1, FIG. 3 is a detailed view, partially in section, of the connection element of the actuating device positioned about a tubular member as taken along line 3—3 of FIG. 2.

Figure 4:
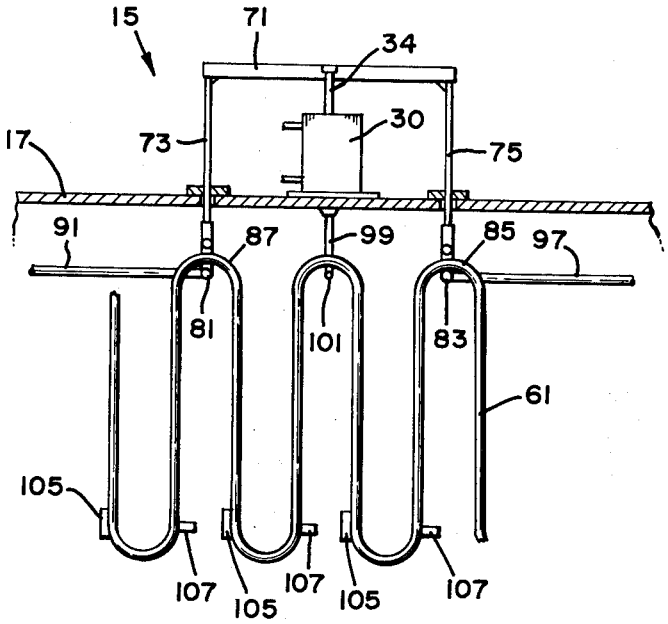
Figure 5:
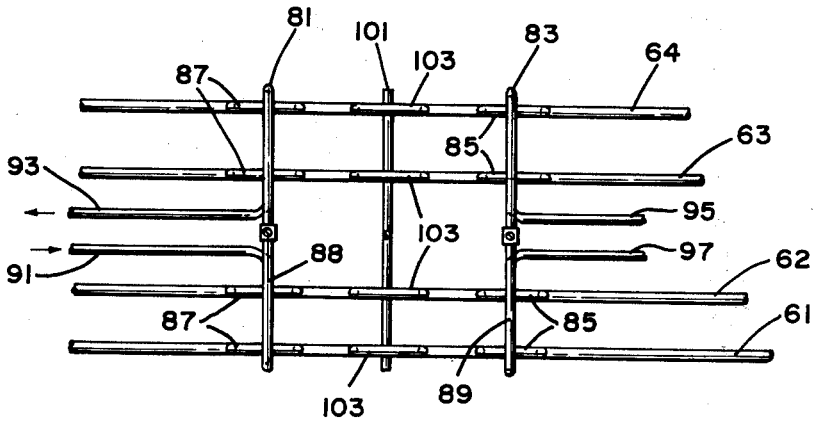

FIG. 4 is a view in elevation and in partial section of a modified actuating device adapted to rap or shake a plurality of tubular arrays, and FIG. 5 is a plan view of the apparatus of FIG. 4 taken along line 5—5 of FIG. 4.

Generally speaking, the present invention contemplates means for rythmically shaking the tubular array of a heat exchanger to remove dust and scale from the external surfaces thereof wherein the period of application of the force by the actuating device is equal to the natural period of vibration of the tubular array, or at low fractional multiples thereof.

More particularly, the force applied to the tubular array acts in the plane containing the tubes and has a direction parallel to the tube runs and, furthermore, is preferably applied at a point of symmetry of the tubular array, with respect to two consecutive tube supports.

Referring now to FIG. 1, there is disclosed a planar tubular array 10 having a serpentine configuration located within a boiler 15 which has a roof 17. Gas inlet 7 admits hot gases into the boiler 15 which exit through gas outlet 9 after contacting the tubular array 10. The tubular array 10 may either be arranged in a plane parallel to the gas flow as shown or perpendicular to the gas flow. The tubular array 10 is connected externally of boiler 15 between the inlet header 14 and an outlet header 16 and is maintained in position by supports 18 and 22 where it passes through the roof 17 of the boiler. These supports or anchors 18 and 22 may be of a conventional type, such as a thermal sleeve welded to both the roof 17 and the tube 12, or the tube may be welded directly to the roof. The actuating device 30 may be anchored or supported externally of the boiler, but preferably, it is roof-mounted. Only the connecting element 32 and a small length of rod 34 linked to the connecting element 32 extend into the boiler 15 proper. The connecting element 32 is illustrated in the Figures (see FIG. 3) as a pair of C-shaped segments bolted together, but, of course, the connecting element may be square or rectangular or take other convenient configurations. At any rate, the connecting element 32 is located at a bight 24 of the tube member 12 in surrounding relation to the tube at that point. Preferably, the connecting element is symmetrically located with respect to two consecutive supports of the tubular array 10. It will be seen that upward movement of the rod 34 will result in application of a force to the lower side of the bight 24 imparting upward movement to the tubular array, and that downward movement of the rod 34 will apply a force to the upper surface of bight 24 and impart a downward movement to the tubular array 10. The rod 34 is connected to a piston 36 (see FIG. 2) which is located in a cylinder 38. The piston divides the cylinder volume into two chambers, an upper chamber 42 and a lower chamber 44. The chamber 42 is provided with an inlet port 46 and the chamber 44 is provided with an inlet port 48. The chamber 42 also has an exhaust port 52 and the chamber 44 has an exhaust port 58. The inlet and exhaust ports are suitably valved (not illustrated). It will be seen that air or another fluid under pressure can be introduced through the inlet port 46 to drive the piston downwardly (simultaneously exhausting the air in chamber 44 through exhaust port 58) and that introduction of air into chamber 44 through inlet port 48 will accomplish the opposite result; that is, the piston 36 will be driven upwardly and the air in chamber 42 exhausted through exhaust port 52. Thus, it is possible to impart upward and downward movement successively to the tubular array 10.

The resonant frequency of a tubular array such as that illustrated will be relatively low; for example, from a fraction of a second (say from about ⅓ or ½ second) up to several seconds (say up to about 3 or 4 seconds). It is possible to calculate, at least in approximate fashion, the resonant frequency of the tubular array. This frequency can then be used as a starting point in regulating the pulsations of the actuating device and then minor adjustments may be made in the frequency so as to achieve the largest amplitude of vibrations for the force applied, which will be found at the resonant frequency. From the configuration of the tubular arrays it will be seen that although the force is applied along the longitudinal axis of the tube runs, that a substantial movement will be induced transverse to that direction. The transverse movement is represented by the arrow 62 in FIG. 1. This transverse movement achieves an amplitude so great that the extremities of some or all of the tube loops come into contact as indicated in the dotted line-showing of FIG. 1. The tube loops thus rap each other sharply to vigorously shake the dust and scale from the outer tube surface. Accumulations of dust and scale on the tubes will increase the mass of the array and so change the natural frequency that some adjustment of the rapping frequency may be required; however, if rapping or shaking is carried out at relatively short intervals, accumulations will not become a problem.

Since the pulsating movement is conducted at the resonance frequency of the tubular array, no more than a moderate force need be applied to achieve a very large amplitude in the vibrations. Thus, the danger of deformation and/or wear of the tube surface adjacent the region in which the force is applied, and also where the tubing is anchored, is minimized or avoided. It is also possible to operate the actuating device at low fractional multiples (say ½ or ⅓) of the resonant frequency, but this procedure has the disadvantage that the force applied to the tubular array must be of increased magnitude.

With the actuating device supported or attached to the frame or roof which also supports and holds the tubes, accidental relative movement of the actuating device with respect to the tubular array can hardly occur during operation or when removing the tubular arrays from the boilers for maintenance. Thus problems of misalignment of the actuating device with the tubular array are avoided.

While a pneumatic means for powering the actuating device has been used for purposes of illustration, either mechanical or electromagnetic actuating means could just as easily be employed for this purpose.

It is clear that an almost irreducible minimum of parts are required inside the boiler for the disclosed method, thus avoiding the deterioration of a large number of parts exposed to the action of the combustion gases and presenting fewer obstacles to the free fall of dust or scale.

The device illustrated involves the application of both upward and downward forces on the tubular array, but it is clear that the same or a similar effect can be achieved by applying only downward or only upward forces on the tubular array.

The actuating device as shown in FIGS. 1 and 2 may also be operated as follows: A positive pressure is maintained in chamber 44 to hold the tubular array in a normally raised position. When it is desired to shake the tubular array, the pressure is released through port 58 and the tube bight 24 begins to move downwardly to an unstressed position. When the tube bight 24 has reached the lower limit of its excursion, pressure is reintroduced into chamber 44 and the tube bight 24 is forced upward to its normal position. Again, the force is applied to the tubular array at the resonant frequency thereof.

If desired, a local reinforcement or anvil may be provided at the area where the force is applied to the tube array to proglong the life of the tube at that point. Similarly, local reinforcements or anvils may be provided at the point where the loops strike together, in order to take care of possible misalignments of adjacent tube loops or to protect the tube.

In FIGS. 4 and 5 an arrangement is shown wherein the rapping or shaking force from a single piston is transmitted to several tubular arrays. The tubular arrays 61, 62, 63 and 64 are positioned in parallel alignment within the boiler 15. The actuating device 30 is mounted on the boiler roof 17 with the operating rod 34 of actuating device 30 extending upwardly therefrom and secured to cross-member 71. The cross-member 71 has a pair of depending link members 73 and 75 which extend through the boiler roof 17 where they are secured, respectively, to water-cooled contacting elements 81 and 83. The contacting elements 81 and 83 are formed of tubing and consist of a loop portion 88, 89 and a pair of elongated legs 91, 93 and 95, 97. The loop portion 88 encircles the bights 87 on the tubular arrays 61, 62, 63, 64 as a group and the loop portion 89 similarly encircles bights 85 as a group on the same tubular arrays. Legs 91, 93 and 95, 97 are connected to water headers (not shown) so that cooling water may be circulated through the contacting elements 81 and 83 to protect them from the hot gases in the boiler 15. A rod 99 is secured to roof 17 and at the lower end thereof is provided with a cross-bar 101 which supports the bights 103 of the tubular arrays. At the lower end of the tubular arrays, where the tubes contact upon vibration, anvils 105 and 107 are provided to protect the tube walls against deformation and wear.

In operation, the actuating device 30 puts link members 73 and 75 into vertical reciprocating motion through the operating rod 34 and the cross-member 71. The link members 73 and 75 transfer this vertical motion to the contacting elements 81 and 83 and thus to the tube bights 87 and 85. The cooling legs 91, 93 and 95, 97 are long enough to provide sufficient flexibility to accommodate the vertical movement of the contacting elements 81, 83. At the resonance frequency, the adjacent anvils 105 and 107 at the lower end of the tube loops come into contact to violently dislodge deposits on the tubes.

Accordingly, it is seen that a relatively simple rapping method has been provided which is capable of achieving a large amplitude of movement of the tubular arrays of heat exchangers to thereby shake them free of dust and scale and, due to the moderate forces applied, can be expected to prolong the life of the tubular arrays while maintaining them in a relatively clean condition during usage.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

I claim:

1. A method for cleaning the external tube surfaces of a tubular array having a looped tube configuration which is exposed to hot dusty gases in a heat exchanger, comprising the step of applying a force in pulses to said tubular array at a frequency corresponding to the resonant frequency of said tubular array, or a low fractional multiple thereof, thereby inducing vibration of said tubular array at the resonant frequency thereof with relatively moderate applied force said applied force being sufficient to induce vibration of a magnitude such that the extremities of adjacent loops of said tubular array are brought into sharp rapping contact to shake the dust and scale from said external tube surface.

2. The method of claim 1 wherein the frequency of application of the force is maintained at ½ or ⅓ the resonant frequency.

3. A method for shaking a serpentine or looped planar tubular array in a heat exchanger to remove dust and scale deposits from the external surface thereof, comprising the step of applying a pulsed force in the plane of the tubular array and in the longitudinal direction of the tube runs at a pulse frequency which corresponds to the resonant frequency of the tubular array, or at a low fractional multiple thereof, to produce relatively large transverse excursions of adjacent loops of said tubular array with moderate applied force said transverse excursions being of sufficient extent to bring the extremities of said adjacent loops into sharp rapping contact with each other to shake the dust and scale from said tubular array.

4. The method of claim 3 wherein the force is applied at a point of symmetry of the tubular array with respect to two consecutive supports.

5. The method of claim 4 wherein the frequency of application of the force is maintained at ½ or ⅓ the resonant frequency.

6. A heat exchanger having a plurality of serpentine planar tubular arrays suspended from the roof of said heat exchanger in parallel vertical planes, means for shaking said tubular arrays to remove dust and scale from the external surfaces thereof, comprising, an actuating means capable of reciprocating vertical movement, means mechanically connecting said actuating means to said tubular arrays including a water-cooled contacting means having a vertically oriented loop configuration extending into close proximity to each of said plurality of tubular arrays and elongated, horizontally extending tubular leg portions connecting said looped contacting means to water headers for cooling, said leg portions being of sufficient length and flexibility to permit vertical movement of said looped contacting means to shake said tubular arrays for removal of dust and scale therefrom.

* * * * *